United States Patent [19]

Leffel et al.

[11] Patent Number: 4,691,614

[45] Date of Patent: Sep. 8, 1987

[54] NONSYMMETRICAL COMPENSATOR FOR HANDGUN

[76] Inventors: Leon E. Leffel, 2473 1st St.; Rick G. Leffel, 2723 W. 1st St., both of Yuma, Ariz. 85364

[21] Appl. No.: 868,951

[22] Filed: May 30, 1986

[51] Int. Cl.[4] ..... F41F 17/12

[52] U.S. Cl. ..... 89/14.3

[58] Field of Search ..... 89/14.05, 14.3, 14.4, 89/14.5; D22/108

[56] References Cited

U.S. PATENT DOCUMENTS

| | | | |
|---|---|---|---|
| 1,380,171 | 5/1921 | Abbot | 89/14.3 |
| 1,605,393 | 7/1925 | Cutts | 89/14.3 |
| 2,322,370 | 1/1943 | Lance | 89/14.3 |
| 2,372,315 | 3/1945 | Catron | 89/14.3 |
| 2,464,010 | 3/1949 | Vonella | 89/129 |
| 2,499,428 | 4/1950 | Tiffany | 89/14 |
| 3,114,289 | 12/1963 | Aulabaugh | 89/14 |
| 3,152,510 | 10/1964 | Ashbrook et al. | 89/14.3 |
| 3,155,003 | 11/1964 | Ruth | 89/14 |
| 3,208,348 | 9/1965 | Lee | 89/14 |
| 3,455,203 | 7/1969 | Pillersdorf | 89/14 |
| 3,808,943 | 5/1974 | Kelly | 89/14 |
| 3,858,481 | 1/1975 | Elliott | 89/14 |

FOREIGN PATENT DOCUMENTS

| | | | |
|---|---|---|---|
| 2332364 | 1/1975 | Fed. Rep. of Germany | 89/14.5 |
| 0815441 | 4/1937 | France | 89/14.3 |
| 8500215 | 1/1985 | PCT Int'l Appl. | 89/14.3 |

OTHER PUBLICATIONS

"Special Guns & Ammo Project: Mag-Na-Porting the .45 Auto", Howard French, Guns & Ammo, Jan. 1976, pp. 36 and 37.

Triggs, N.R.A. (Illustrated Firearms Assembly Handbook) (It's Very Easy), 1960, pp. 21-22.

*Primary Examiner*—Stephen C. Bentley

*Assistant Examiner*—Stephen Johnson

*Attorney, Agent, or Firm*—Cahill, Sutton & Thomas

[57] ABSTRACT

A compensator having an enlarged chamber is threaded onto the barrel of a handgun. The compensator has two equally sized, symmetrically positioned vertical upper ports aligned with matching ports in the threaded portion of the barrel, for vertically exhausting high pressure gas to produce a downward force that resists muzzle climb. The chamber also includes a pair of unequally sized, unsymmetrically positioned low pressure ports through which lower pressure gases are exhausted as the bullet leaves the chamber, compensating for rotation produced by the torque produced on the bullet by rifling of the barrel bore as the bullet accelerates.

7 Claims, 9 Drawing Figures

NONSYMMETRICAL COMPENSATOR FOR HANDGUN

BACKGROUND OF THE INVENTION

The invention relates to devices for resisting muzzle displacement caused by counterforces produced on a handgun by a bullet as it is fired, which displacements reduce shooting accuracy.

Good target pistol marksmen know that when a large caliber pistol, for example, a .45 caliber pistol is fired, the lands and grooves inside the barrel bore causing the bullet to spin produces a counter reaction torque on the barrel, tending to rotate the handgun counterclockwise along the axis of the barrel. This tends to cause the handgun to "twist" about the handle of the handgun as it is held by the shooter. The backward thrust of the pistol, in combination with the "twist", inevitably causes the outer end of the barrel to be displaced upward and sideways. The amount of such displacement of the barrel occurring before the bullet leaves the barrel is enough to cause appreciable inaccuracy in the aim of even an expert handgun marksman.

The firearm art is replete with a wide variety of gun barrel accessories that have been primarily designed to act as "muzzle brakes" which reduce the recoil produced by firing of the weapon, and in some instances to reduce muzzle climb caused by the recoil and improve the accuracy of the handgun. The state-of-the-art is generally indicated by U.S. Pat. Nos. 3,858,481 (Elliott), 3,808,943 (Kelly), 3,455,203 (Pillersdorf), 3,208,348 (Lee), 3,155,003 (Ruth), 3,114,289 (Aulabaugh), and 2,499,428 (Tiffany), and also by the article "Mag-Na-Porting the .45 Auto", (French) "Guns & Ammo", January 1976, page 36 et seq., the latter reference describing application of the technique of the above-mentioned Kelly patent to a military Colt .45 automatic handgun.

Although the technique described in the above Kelly patent can be effective in preventing muzzle climb, it does not compensate for the "twist" produced on a handgun as a result of firing a bullet.

There remains a need for a simple, inexpensive compensator that will more effectively counter all of the counterforces produced in reaction to firing of a bullet more effectively than the prior art and eliminate the effects of such counterforces on shooting accuracy of the firearm more effectively than compensators of the prior art.

SUMMARY OF THE INVENTION

Accordingly, it is an object of the invention to provide a compensating apparatus and method that more effectively counter muzzle climb and twisting of a handgun as a result of counteforces produced by firing a bullet than compensators of the prior art.

It is another object of the invention to provide a compensator that effectively compensates for twist of the handgun produced by countertorque resulting from spin imparted by the rifling of a handgun to a bullet as the bullet is fired.

Briefly described, and in accordance with one embodiment thereof, the invention provides a compensating device for attachment to the distal end of a firearm barrel including a pair of rear high pressure ports that are symmetrically disposed about an axis of the gunsight, exhausting high pressure gases upward at equal predetermined angles on opposite sides of a vertical axis of the barrel and gunsight to resist muzzle climb, and also includes an enlarged chamber through which the bullet passes and in which expanded gases move forward and strike a conically sloped front wall of the compensator surrounding the bullet exit opening. Nonsymmetrically sized and nonsymmetrically located low pressure forward ports exhaust low pressure gases vertically upward from the chamber to thereby resist twist of the firearm to countertorque produced on the firearm by rifling in its barrel. The conically sloped wall produces an anti-recoil counterforce, and also produces outward deflection of the gases that result in a downward force on the bottom wall of the chamber to further resist muzzle climb and simultaneously nonsymmetrically exhausting low pressure gases through the nonsymmetrically sized and positioned low pressure ports to produce the torque that resists twist of the firearm, in addition to resisting the muzzle climb.

DESCRIPTION OF THE INVENTION

Figure 1:
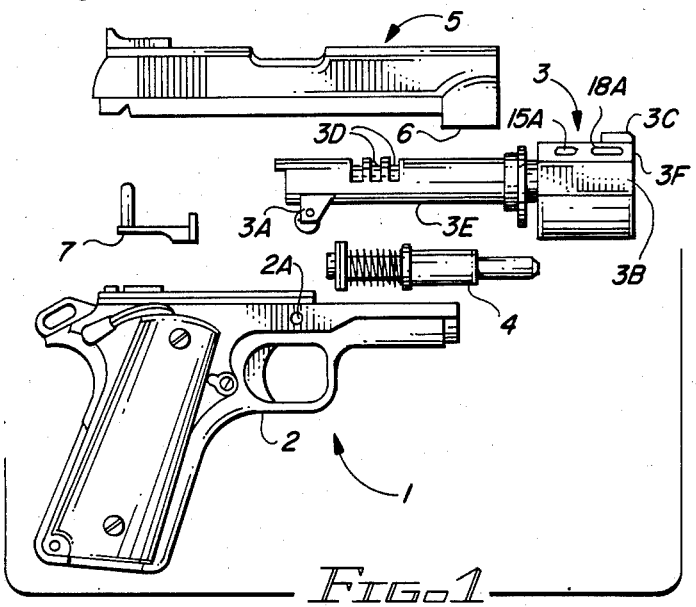
FIG. 1 (PRIOR ART)
FIG. 1 is a plan view illustrating the main components of a colt semiautomatic handgun of the prior art.
Figure 5:
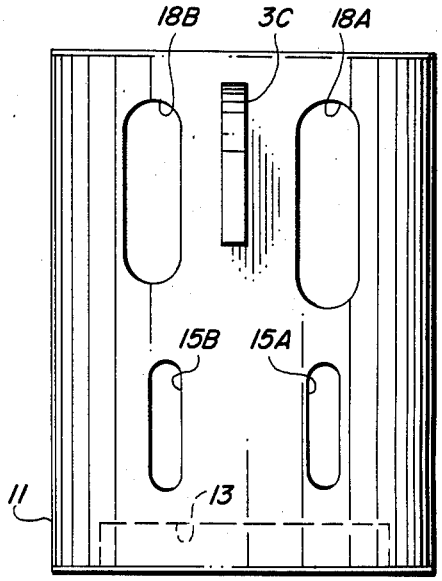
FIG. 5 is a top view of the compensator of FIG. 3.

Referring now to FIG. 1, a prior art semiautomatic colt handgun 1 includes a frame 2. A barrel 3 includes a linkage 3A having a hole which is aligned with holes 2A in the main frame 2 and retained therein by a pin 7. Barrel 3 has a compensator 3B threaded onto its distal end, having a lower hole therein for receiving a spring guide 4. Spring 4 extends through a bushing 6 rigidly attached to the lower side of a slide 5. A gunsight 3C is provided on the upper surface of compensator 3B. A pair of ports 3F are disposed symmetrically on opposite sides of the gunsight 3C to exhaust low pressure gases and resist muzzle climb, increasing the accuracy of the handgun.

Figure 2:
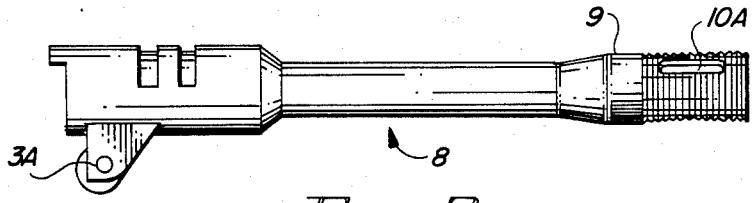
FIG. 2 is a plan view of a custom-made barrel having a threaded end and symmetrical high pressure exhaust ports for receiving the compensator of the present invention for attachment to the handgun of FIG. 1 in place of the standard barrel thereof.
Figure 3:
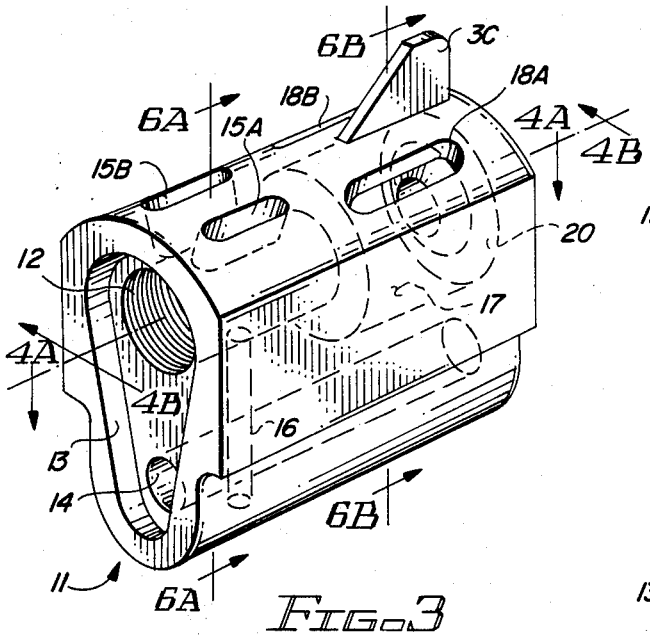
FIG. 3 is a partial perspective view of the compensator of the present invention.
Figure 4A:
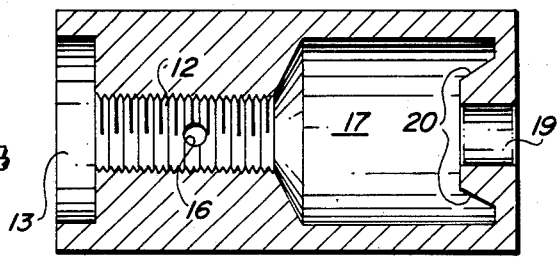
FIG. 4A is a section view of the compensator of FIG. 3.
Figure 4B:
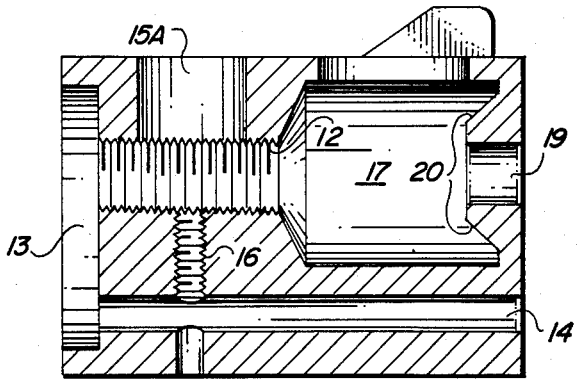
FIG. 4B is another section view of a compensator of FIG. 3.

In accordance with the present invention, the standard barrel 3 is replaced by a 6 inch barrel 8, shown in FIG. 2, having a slightly enlarged threaded end 9. Threaded end 9 of the threaded end of the barrel has a pair of inclined high pressure exhaust ports 10A that are symmetrically disposed about a center line through the center of the gunsight 3C.

The compensator 11, shown in FIGS. 3, 4A, 4B, 5, 6A, 6B, and 7 is threaded onto the threaded end 9 of barrel 8. Compensator 11 includes a threaded bore 12 by means of which it is screwed onto the threaded end 9 of barrel 8. A spring guide hole 14 receives the spring guide 4. A pair of elongated, vertical, high pressure rear ports 15A and 15B disposed symmetrically about a perfectly centered gunsight 3C are aligned with the above-mentioned ports 10A and 10B in threaded end 9 of barrel 8.

An enlarged expansion chamber 17 is provided in the right-hand end of compensator 11. A bullet exit hole 19 coaxial with the bore of barrel 8 is provided in a frusto-conical inner surface 20 of a wall bounding the right-hand end of enlarged expansion chamber 17, providing a thrust base for gases expanding into chamber 17.

A pair of vertical low pressure forward ports 18A and 18B are disposed in the forward portion of compensator 11. The right-hand low pressure port 18A is longer and wider than the left-hand forward port 18B, and is located further to the right of gunsight 3A than port 18B is located to the left thereof.

A threaded hole 16 for a set screw is provided in compensator 11 to lock the position of compensator 11 onto the threaded end 9 of barrel 8 after compensator 11 has been threaded precisely onto threaded end 9 so that the position of compensator 11 does not interfere with action of the slide 5 during operation. Recess 13 in the left-hand end of compensator 11 performs the function of receiving a barrel bushing.

The present embodiment of the invention was designed and constructed for use in conjunction with a Colt Combat Commander 38 semiautomatic handgun and a Colt Combat Commander 45 caliber semiautomatic handgun and various copied versions thereof.

The length of the compensator is 1.725 inches. The diameter of the expansion chamber 17 is 0.700 inches. The threaded bore 12 is thirty-seven sixty-fourths of an inch in diameter. The length of each of the rear high pressure ports 15A and 15B is 0.600 inches, the width of each is 3/32 of an inch. The spacing between them is 0.225 inches. The width of each of the forward low pressure ports 18A and 18B is 3/16 of an inch. The length of left forward port 18B is 0.5500 inches, and it is spaced 0.120 inches from the center line of gunsight 3A. Right-hand low pressure port 18A is 0.5850 inches long, and it is spaced 0.180 inches from the center line of gunsight 3A. The overall length of compensator 11 is chosen to provide an optimum weight of about 8 ounces, and the placement of the expansion chamber and two forward low pressure ports 18A and 18B are selected to provide optionally reduced compensation of muzzle climb and twist. The axial length of expansion chamber 17 is 0.730 inches, and the heighth of the conical thrust base forming the forward wall of expansion chamber 17 is 0.030 inches, and the slope angle thereof is 27°.

Figure 6A:
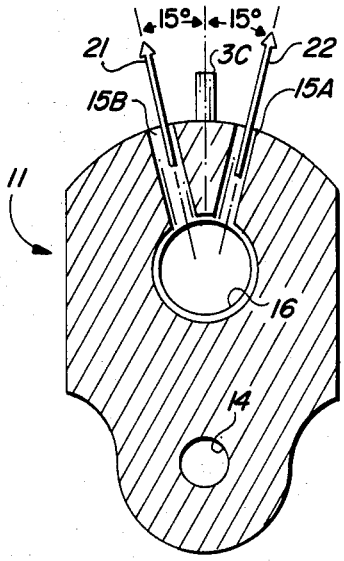
FIG. 6A is a section view along section line 6A—6A of FIG. 3.

As best seen in FIG. 6A, the rear high pressure ports 15A and 15B exhaust high pressure gas upwardly and outwardly at opposed 15° angles to the vertical axis of the barrel face and the gunsight, as indicated by arrows 21 and 22, providing a strong resistance to muzzle climb when the bullet is fired.

Figure 6B:
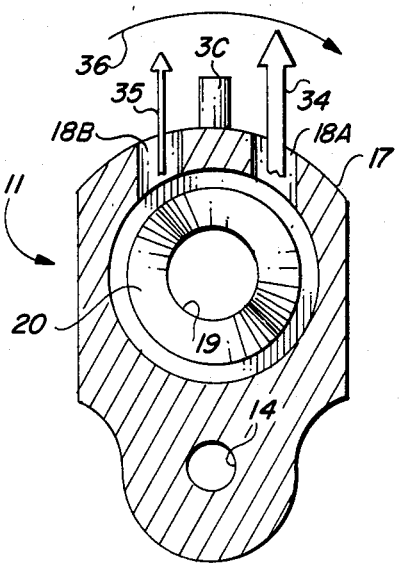
FIG. 6B is a section view along section line 6B—6B of FIG. 3.

As shown in FIG. 6B, the forward nonsymmetrical low pressure ports 18A and 18B are oriented vertically, and exhaust gases upward vertically, as indicatd by arrows 34 and 35, respectively. This results in a countertorque being produced about the longitudinal axis of the barrel, as indicated by arrow 36. This countertorque reduces the above-mentioned "twist" of the handgun.

Next, the aspect of operation pertaining to the conical front wall or thrust base 20 will be described with reference to the section view of FIG. 7, in which reference numeral 25A designates the location of a bullet being fired just after it has entered the compensator 16 and has passed by the high pressure rear ports 15A and 15B. At this point, none of the gases propelling the bullet have had any chance to expand or escape, so the gas pressure is very high. Reference numeral 33 shows how the high pressure gas escapes through symmetrical rear ports 15A and 15B, producing a net symmetrical downward force on the distal end of the barrel, tending to resist muzzle climb.

After the bullet passes from the location indicated by reference numeral 25A into the expansion chamber 17, the gases rapidly expand. The gases tend to overtake the bullet in chamber 17, and strike the outwardly flared conical surface 20. Gases in the upper portion of the chamber are repelled outwardly and upwardly from the upper portion of sloped surface 20. The upwardly repelled gases 30 pass through the unsymmetrical forward ports 18A and 18B, producing both a downward force and a clockwise torque on the barrel, as seen to the shooter. Simultaneously, the gases repelled downward by the lower portion of sloped surface 20 encounter the "bottom" of the chamber 17, producing a downward force thereon. The foregoing clockwise torque tends to resist the above-described twisting force produced by the countertorque produced in reaction to spin imparted by the rifling of the barrel to the accelerating bullet.

Figure 7:
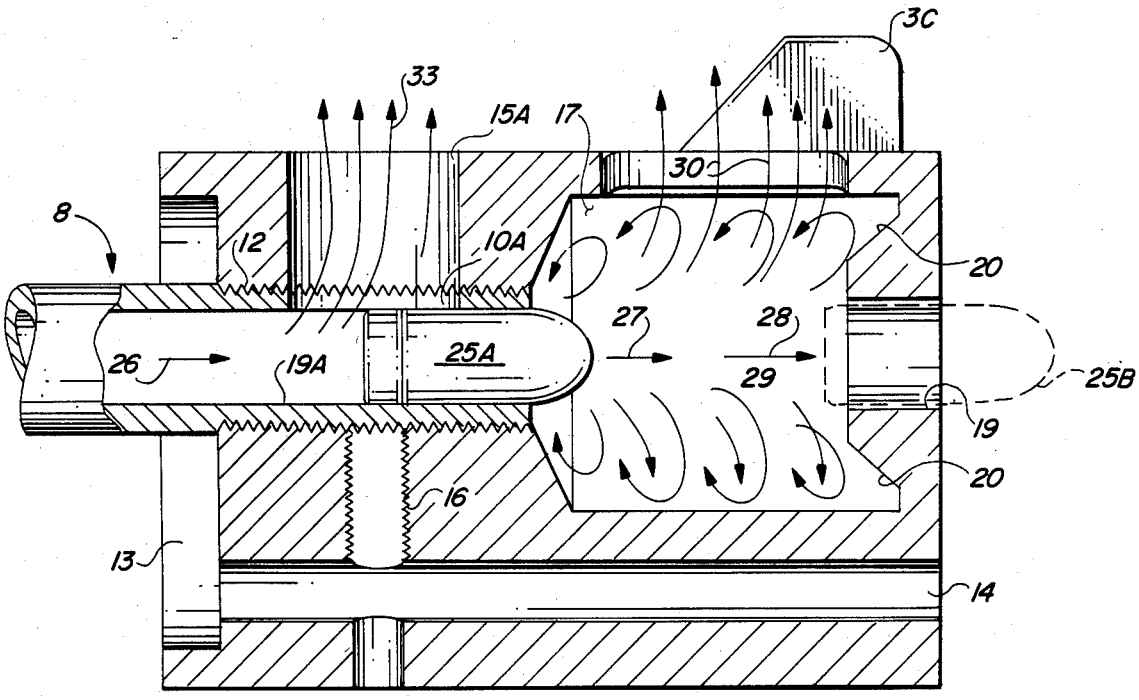
FIG. 7 is a section view useful in explaining the operation of the compensator of the present invention.

Furthermore, there is a net force to the right as a result of the blast of gases moving to the right (as shown in FIG. 7) and striking the left wall of chamber 7, tending to resist recoil. By the time the bullet reaches the location designated by reference numeral 25B in FIG. 7, a substantial anti-recoil force and an anti-muzzle-climb force has been produced on the distal end of the barrel.

Our experiments have shown that the above-described compensator results in a significant improvement in the accuracy of an expert marksman. The compensator causes a loss of only about 14 to 15 feet per second in the velocity of the bullet, as determined by velocity measurements were made with an electronic photoelectric chronograph timer manufactured by Oehler Research, Model 33.

Testing of several compensators that we have made in accordance with the above-described invention have been tested by expert marksmen in the following manner. First, a qualified marksmen was asked to fire a prior art ACCU-COMP II compensator by Bill Wilson, on a Model 1911 .45 caliber colt combat commander handgun at a target 20 yards away. The elapsed time between shots was accurately timed with a Pro Timer II electronic sound metering-timing device manufactured by Competition Electronics. The elapsed time between the first and second shots was measured to be 0.30 seconds. The first shot fired was precisely on target, and the second shot hit the target 7.5 inches upward from the bull's-eye and slightly to the right. This test was repeated approximately three times. The best spacing between the first and second rounds on the target was 7.5 inches, and the worst spacing was 9.75 inches. In each instance, the second round was located in the upper right-hand corner of the target, indicating the amount of muzzle climb and also the amount of "twist" resulting from firing of the first shot.

Then, the same marksman was asked to fire exactly the same rounds, with identical bullet weight and other components identical, except that our above-described compensator was utilized instead of the ACCU-COMP II compensator. The time measured between first and second rounds varied from 0.22 seconds to 0.28 seconds. The second shot was always precisely vertically positioned above and within 1.5 to 2.0 inches of the first shot.

In other tests of our compensator, a so-called timed speed-accuracy test was performed in a national competition. In this competition, the shooter stands with his hands up (i.e., the surrender position), facing down range toward three targets spaced two feet apart and 15 yards away from the shooter. The pistol is holstered. When a buzzer is actuated, starting the electronic timer and signaling the shooter to begin firing, the shooter draws the holstered pistol, aims, and fires two rounds at each of the three targets, reloads the pistol with six more rounds, and shoots two rounds at each target. When the last shot is fired, the electronic timer is automatically stopped. In this event, a marksman using a HAMMOND prior art compensator achieved a time of 6.00 seconds with all shots being within an 8 inch circle. Then, the same shooter, using our compensator, made all 12 shots within the 8 inch circle in only 4.71 seconds. This shows that the amount of muzzle displacement is less for our compensator, allowing more rapid recovery and faster shooting times.

We have also had registered marksmen who themselves own prior art compensators, shoot our compensated gun. Due to the muzzle climb and recoil of their personal handguns) such marksmen have developed a "built-in flinch", or automatic reaction to their own handgun's recoil. This "flinch reaction" invariably causes them to fire their second shot 8 to 9 inches low on a target 15 feet distant. The "flinch reaction" is developed by them in the course of shooting their own firearms in order to compensate for the recoil and twist of their personal handgun. We have discovered that for expert marksmen, this "flinch reaction", wherein they unconsciously react to muzzle climb and twist, can be avoided. By learning to relax, aim the pistol, and pull the trigger and then fire again as fast as possible, good marksmen can avoid the flinch reaction and place the second round within a few inches from the first, after only a few tries.

While the invention has been described with reference to a particular embodiment thereof, those skilled in the art will be able to make various modifications to the described embodiment of the invention without departing from the true spirit and scope thereof.

We claim:

1. A compensating apparatus for resisting both muzzle climb and twist of a handgun in reaction to firing a bullet, the compensating apparatus comprising in combination:

(a) a threaded end of a barrel of the handgun, and first and second high pressure gas outlet ports disposed on either side of an imaginary vertical plane passing through the center of a bore through the barrel and through a gunsight of the handgun; and (b) a compensator including a threaded bore receiving the threaded end of the barrel and also including an enlarged expansion chamber into which high pressure gas following a bullet being fired can expand, the compensator including third and fourth high pressure gas outlet ports aligned with the first and second high pressure gas outlet ports, respectively, the compensator also including first and second vertical low pressure gas outlet ports extending from upper surface portions of the compensator on either side of the imaginary vertical plane into the enlarged expansion chamber, the second vertical low pressure gas outlet port being substantially larger than the first vertical low pressure gas outlet port, the second vertical low pressure gas outlet port being located further from the imaginary vertical plane than the first vertical low pressure gas outlet port, whereby nonsymmetrically, non-radially discharged amounts of low pressure gas from the enlarged expansion chamber produce a countertorque resisting twist of the handgun due to counterforce applied by the accelerating bullet to rifling of the bore of the barrel, high pressure gas upwardly exhausted from the third and fourth high pressure gas outlet ports effectively resisting muzzle climb.

2. The compensating apparatus of claim 1 wherein the enlarged expansion chamber includes a distal end wall having a bullet exit hole through which the bullet can pass and also has a frustoconical wall surrounding the bullet exit hole, whereby high pressure gas follows the bullet, expands into the enlarged expansion chamber, and strikes the sloped frustoconical wall, producing inclined deflections of the gas from the frustoconical wall, gas deflected from the upper portion of the frustoconical wall producing an anti-recoil forward component of force on the frustoconical wall, enhancing exhausting of low pressure gas from the expansion chamber through the first and second low pressure gas outlet ports, gas deflected from the lower portion of the frustoconical wall striking the bottom of the chamber, producing a downward force thereon tending to resist muzzle climb.

3. The compensating apparatus of claim 2 wherein the first and second high pressure gas outlet ports are equal in size and are symmetrically disposed about the imaginary vertical plane.

4. The compensating apparatus of claim 3 wherein the first, second, third, and fourth high pressure gas outlet ports are symmetrically inclined with respect to the imaginary vertical plane.

5. The compensating apparatus of claim 4 wherein the first, second, third, and fourth high pressure gas outlet ports are substantially elongated, and wherein the first and second low pressure gas outlet ports are substantially elongated.

6. The compensating apparatus of claim 3 adapted for use on a COLT Model 1911 COMBAT COMMANDER .45 caliber type of semiautomatic handgun, wherein the barrel is 6 inches long and wherein the compensator weighs approximately 8 ounces, wherein the third and fourth high pressure gas outlet ports each are 3/32 of an inch wide and 600 mils long, wherein the first low presure gas outlet is located to the left of the imaginary vertical plane, is 3/16 of an inch wide and is 0.550 inches long, and is located 0.120 inches from the vertical imaginary plane, and wherein the second low pressure gas outlet port is 3/16 of an inch wide, 0.5850 inches long, and is located 0.180 inches from the imaginary vertical plane.

7. The compensating apparatus of claim 6, wherein the length of the expansion chamber is 0.730 inches and wherein the expansion chamber is cylindrical and its diameter is 0.700 inches.

* * * * *